US005354218A

United States Patent [19]

Fry et al.

[11] Patent Number: 5,354,218

[45] Date of Patent: Oct. 11, 1994

[54] ELECTRICAL CONNECTOR WITH IMPROVED TERMINAL LATCHING MEANS

[75] Inventors: Rupert J. Fry, Des Plaines; John S. Luthy, Naperville, both of Ill.

[73] Assignee: Molex Incorporated, Lisle, Ill.

[21] Appl. No.: 122,260

[22] Filed: Sep. 16, 1993

[51] Int. Cl.[5] ..... H01R 13/40

[52] U.S. Cl. ..... 439/595

[58] Field of Search ..... 439/594, 595, 599, 733, 439/744, 752

[56] References Cited

U.S. PATENT DOCUMENTS

| | | | |
|---|---|---|---|
| 4,329,009 | 5/1982 | Bungo . | |
| 4,664,460 | 5/1987 | Vandame . | |
| 4,758,182 | 7/1988 | Anbo et al. | 439/592 |
| 4,979,912 | 12/1990 | Shindo et al. | 439/595 |
| 5,026,304 | 6/1991 | Furrow | 439/595 |
| 5,057,040 | 10/1991 | Kodama et al. | 439/595 |
| 5,139,447 | 8/1992 | Yoneda et al. | 439/595 X |
| 5,160,279 | 11/1992 | Sagawa et al. | 439/595 |
| 5,261,834 | 11/1993 | Yamanashi | 439/595 |

*Primary Examiner*—Khiem Nguyen

*Attorney, Agent, or Firm*—Stephen Z. Weiss

[57] ABSTRACT

An electrical connector includes a dielectric housing having generally rigid walls defining an elongated terminal-receiving passageway. At least one latch wall is disposed within and extends longitudinally of the passageway. The latch wall defines opposite longitudinal edges thereof, with one longitudinal edge being integrally joined to the generally rigid walls of the housing. The other longitudinal edge of the latch wall is free and projects into the passageway for transverse flexing about the one joined edge. A latch shoulder is provided on the latch wall at least on a flexing portion of the wall. A terminal is adapted to be inserted into the passageway. The terminal has a latch shoulder for snapping behind the latch shoulder of the latch wall to prevent removal of the terminal from the passageway.

10 Claims, 3 Drawing Sheets

ELECTRICAL CONNECTOR WITH IMPROVED TERMINAL LATCHING MEANS

FIELD OF THE INVENTION

This invention generally relates to the art of electrical connectors and, particularly, to a latching system or means for holding terminals in passageways of a connector housing.

BACKGROUND OF THE INVENTION

A wide variety of mating electrical connectors employ pairs of interengaging pin and socket terminals for interconnecting a plurality of circuits or wires through the mated connectors. The pin and socket terminals often are called male and female terminals, respectively.

The terminals are mounted in a plurality of terminal-receiving passageways in a dielectric housing of the electrical connector. The terminals generally are elongated and are inserted into the passageways along the longitudinal axes of the terminals. Some form of latch means normally are provided to hold the terminals in the passageways against withdrawal therefrom.

Various types of terminal latch means have consistently presented various problems. For instance, the terminals often are provided with outwardly projecting, cantilevered flexible latch arms which snap behind shoulders within the terminal-receiving passageways of the connector housing. The cantilevered latch arms have a tendency to bend, break and/or snag on other parts. For instance, the latch arms may be bent or collapsed on a reel of interconnected terminals during shipping, prior to fabricating the connector. In addition, in order to have any significant latching capabilities, the latch arms must be of a sufficient width which often limits the width of the contact portions of the terminals and, in turn, causes over-heating.

In order to avoid those problems wherein the latch means are provided by cantilevered flexible latch arms on the terminals, cantilevered latch arms have been provided on the connector housing itself. The housing normally is molded of plastic material, and the cantilevered latch arms are molded integrally therewith and extend inwardly into the terminal-receiving passageways from interior housing walls. These cantilevered latch arms on the housing have limited strength and durability. They also present problems during manufacture, because the molded plastic material must flow down the entire length of the arms. The arms also take up "real estate" within the connector housing and make it difficult to provide adequate insulation between adjacent terminals.

This invention is directed to solving the above myriad of problems by providing a simple and reliable latching system for terminals in an electrical connector of the character described.

SUMMARY OF THE INVENTION

An object, therefore, of the invention is to provide a new and improved latching system or means for holding terminals in passageways of an electrical connector housing.

In the exemplary embodiment of the invention, an electrical connector is disclosed with a dielectric housing having generally rigid wall means defining an elongated terminal-receiving passageway. A terminal is adapted to be inserted into the passageway. Each terminal has a longitudinal axis and a mating portion adapted to mate with a complementary terminal inserted into the respective passageway. Generally, latch means are provided to hold the terminal in the terminal-receiving passageway in the housing.

Specifically, the invention is directed to an improvement in the latch means for the terminal and includes at least one latch wall disposed within and extending longitudinally of the terminal-receiving passageway of the housing. The latch wall defines opposite longitudinal edges. One longitudinal edge is joined to the generally rigid wall means of the housing. The other longitudinal edge is free and projects into the respective passageway for transverse flexing about the one joined edge. A latch shoulder is provided on the latch wall at least on a flexible portion of the wall. The terminal includes a latch shoulder for snapping behind the latch shoulder of the latch wall to prevent removal of the terminal from the passageway.

As disclosed herein, the dielectric housing, including the generally rigid wall means and the latch wall, is unitarily molded of plastic material. Therefore, a longitudinal integral juncture is provided between the rigid wall means and the latch wall to define a living hinge for flexing of the latch wall. The latch shoulder on the latch wall is defined by an integral boss projecting transversely into the terminal-receiving passageway. The terminal is stamped and formed from sheet metal material and includes a male mating end, a terminating end and an intermediate body portion between the ends. The latch shoulder on the terminal is located on the intermediate body portion thereof. Preferably, a pair of the latch walls extend along opposite sides of the terminal-receiving passageway and between which a respective terminal is inserted.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
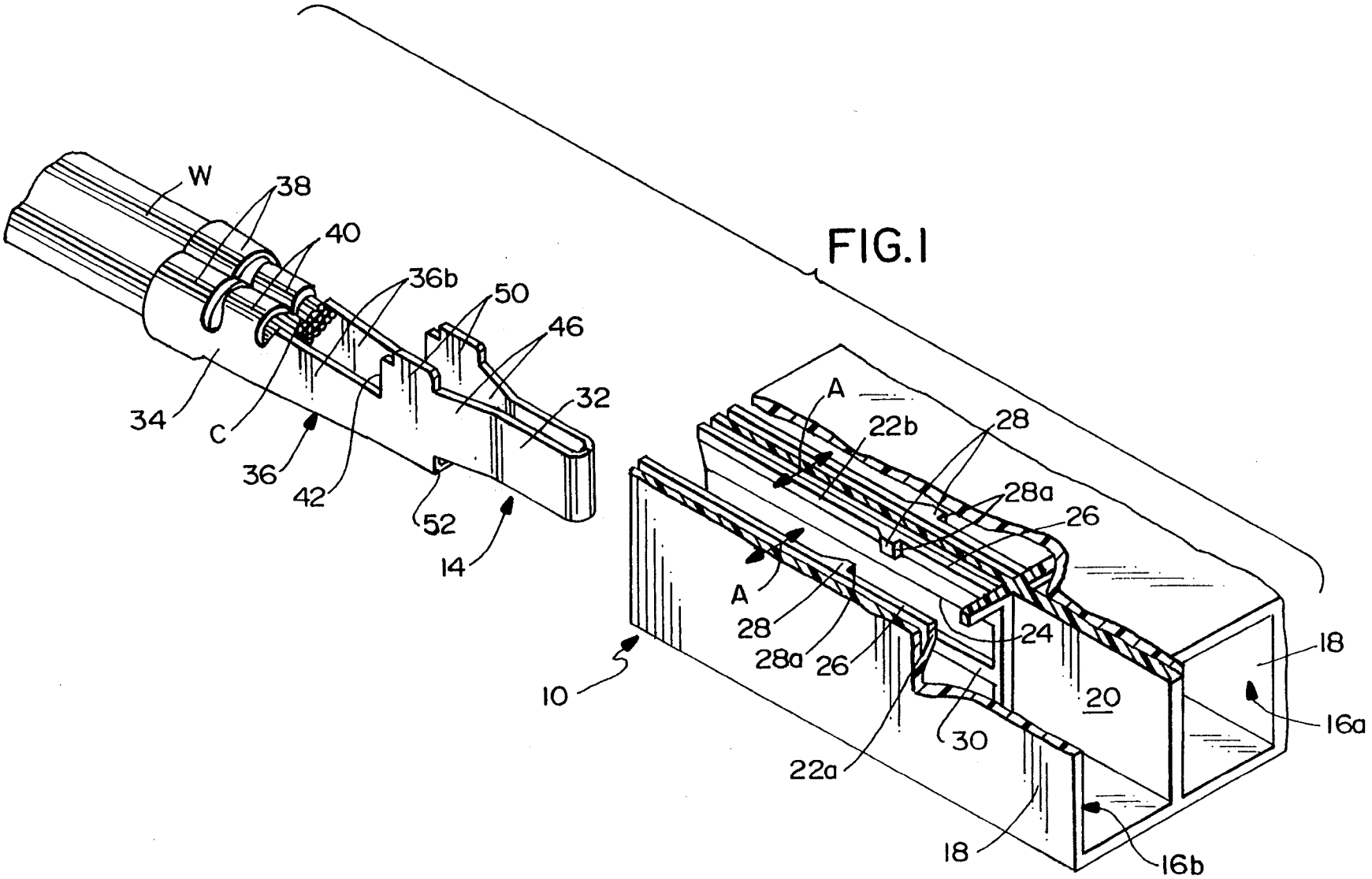
FIG. 1 is a perspective view, partially cut away to show the interior of a connector housing having two terminal-receiving passageways, along with one of the terminals, and incorporating the concepts of the invention.

Referring to the drawings in greater detail, FIG. 1 shows a two-passageway connector housing, generally designated 10, and incorporating the concepts of the invention. The housing is adapted for receiving a pair of electrical terminals, generally designated 14 in FIGS. 5–7 and 8.

More particularly, referring to FIG. 1, dielectric housing 10 includes generally rigid wall means defining a pair of elongated terminal-receiving passageways indicated generally at 16*a* and 16*b*. The generally rigid wall means include a pair of outside walls 18 and a center wall or partition 20. A plurality of latch walls 22*a* and 22*b* are disposed within and extend longitudinally of each terminal-receiving passageway 16*a* and 16*b*. Specifically, outside latch wall 22*a* and inside latch wall 22*b* are disposed on opposite sides of each passageway.

Dielectric connector housing 10, including its generally rigid wall means 18 and 20, along with latch walls 22*a* and 22*b*, is unitarily molded of plastic material. It can be seen that each latch wall 22*a* and 22*b* is elongated and defines opposite longitudinal edges 24 and 26. Edges 24 are joined to the respective walls 18 and 20. Edges 26 are free and project into the respective terminal-receiving passageways for transverse flexing about joined edges 24 in the direction of double-headed arrows "A". In essence, with the housing unitarily molded of dielectric plastic material, "joining" edges 24 define elongated living hinges for flexing of the latch walls transversely of the longitudinal axes of terminal-receiving passageways 16*a* and 16*b*. Lastly, each latch wall 22*a* and 22*b* of connector housing 10 in FIG. 1 includes a latch boss 28 defining a latch shoulder 28*a* for purposes described hereinafter. The latch bosses project into the terminal-receiving passageways.

Figure 2:
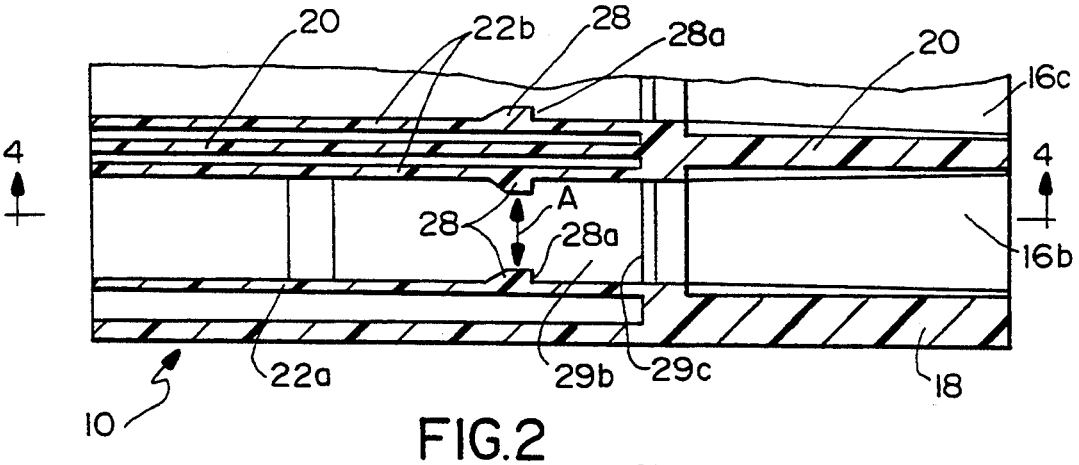
FIG. 2 is a horizontal axial section through the connector housing.
Figure 3:
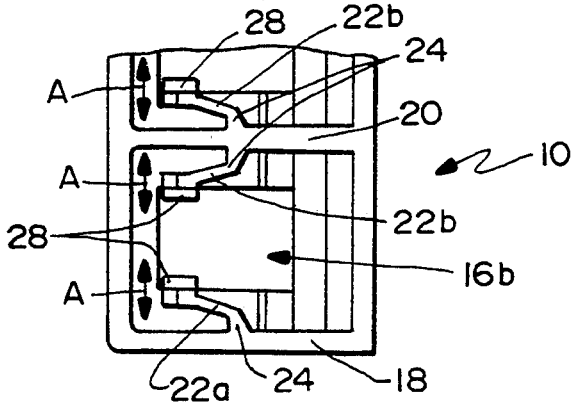
FIG. 3 is an end elevational view of the housing of FIG. 2.
Figure 4:
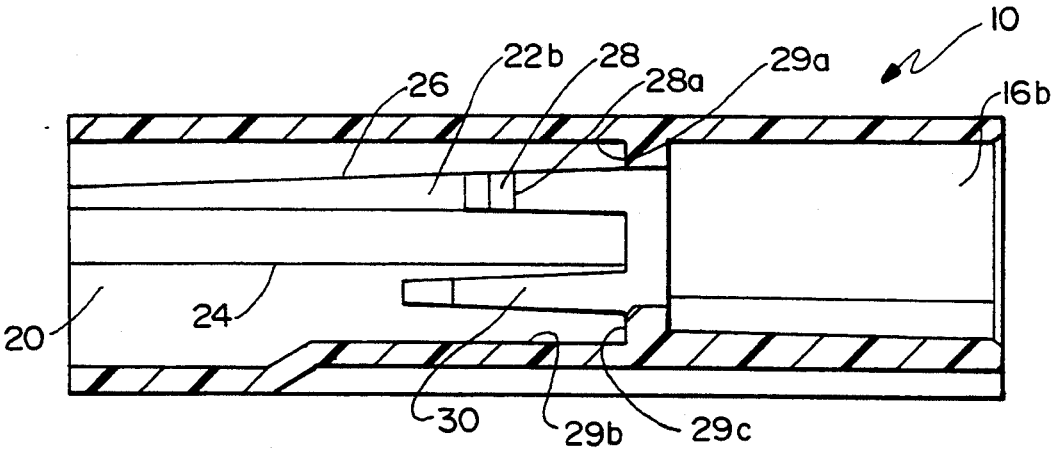
FIG. 4 is a vertical section taken generally along line 4—4 of FIG. 2.
Figure 5:
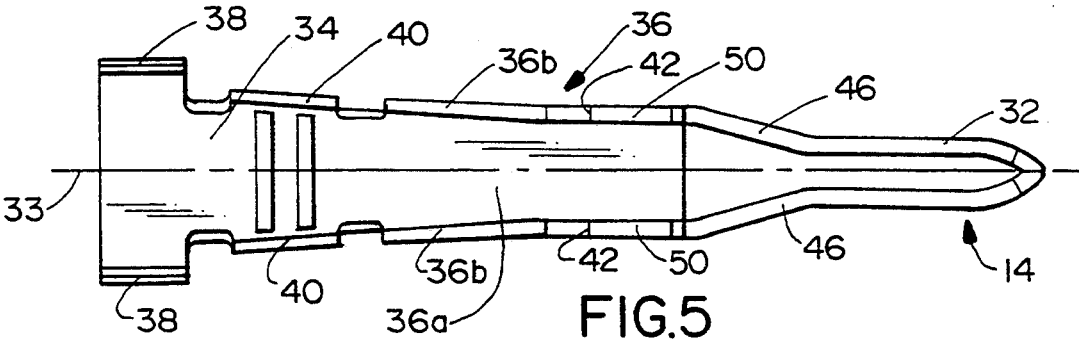
FIG. 5 is a top plan view of a terminal for insertion into one of the passageways in the housing.
Figure 6:
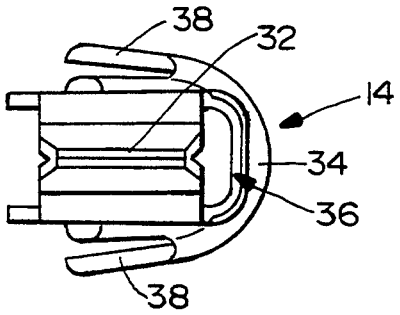
FIG. 6 is an end elevational view of the terminal, looking toward the right-hand end of FIG. 5.
Figure 7:
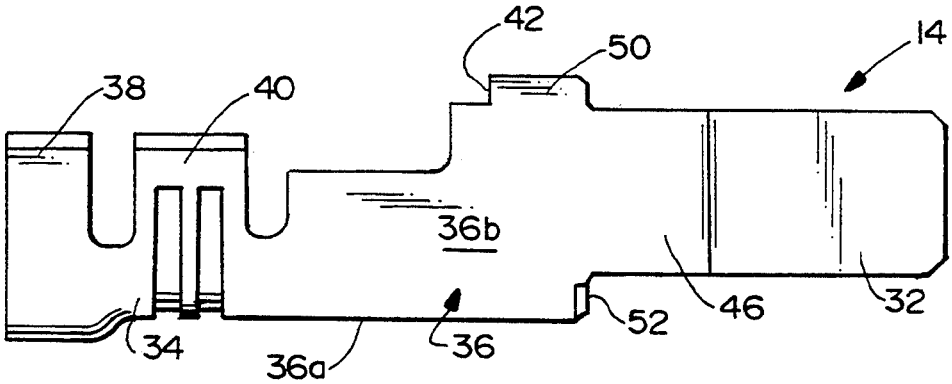
FIG. 7 is a side elevational view of the terminal.

Turning next to FIGS. 2–4, connector housing 10 is shown in greater detail. Each terminal-receiving passageway includes an upper cavity wall portion 29*a*, a lower cavity wall portion 29*b* and a stop shoulder 29*c*, all seen in FIG. 4 and for purposes described hereinafter. FIG. 4 also shows side stabilizing ribs 30 integral with rigid walls 18 and 20. FIG. 2 best shows the shape of latch bosses 28 and latch shoulders 28*a*. FIG. 3 best shows the shape of latch walls 22*a* and 22*b*. Both FIGS. 2 and 3 show the flexing direction of the latch walls as indicated by double-headed arrow "A".

Referring now to FIGS. 1 and 5–7, each terminal 14 is elongated and is stamped and formed from sheet metal material. The terminal defines a longitudinal axis 33. The terminal includes a front blade-like male mating end 32, a rear terminating end 34 and an intermediate body portion 36 between the ends. Terminating end 34 includes two pairs of crimp arms 38 and 40, crimp arms 38 being adapted for crimping onto the outside insulation or cladding of an insulated electrical wire "W" (FIG. 1), and crimp arms 40 being adapted for crimping onto and terminating the electrical conductive core "C" of the wire, all of which is well known in the art. Lastly, intermediate body portion 36 is generally U-shaped to define a bottom wall 36*a* and a pair of side walls 36*b*. Each side wall has a latch shoulder 42 stamped in the upper edge thereof. Therefore, the remainder of side walls 36*b* and bottom wall 36*a* provide a substantial massive body portion of the terminal of excellent current flow characteristics.

Figure 8:
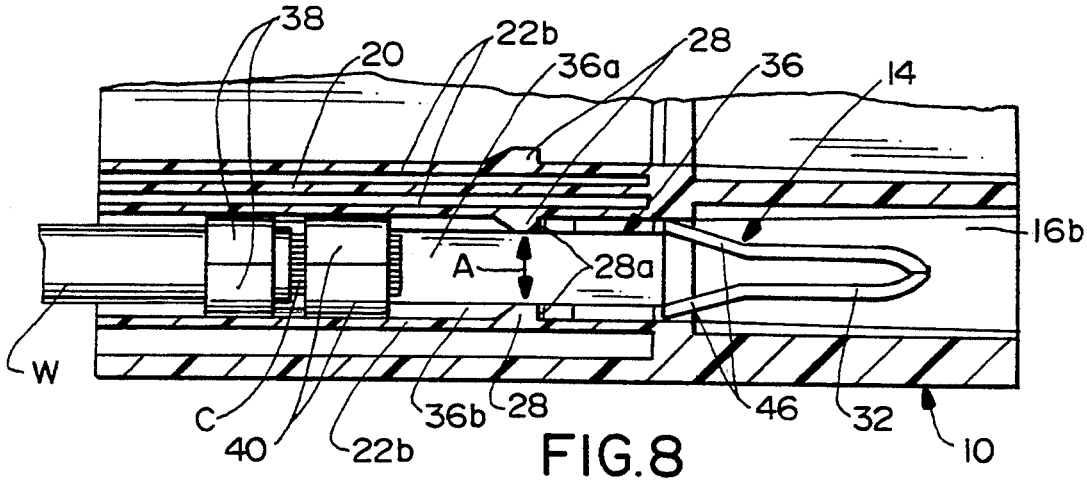
FIG. 8 is a view similar to that of FIG. 2, with one of the terminals inserted into the passageway of the housing.

The insertion of one of the terminals 14 into one of the passageways in connector housing 10, and the operation of the latching system of the invention, now will be described in relation to FIG. 8 which shows a terminal 14 inserted into passageway 16*b* of connector housing 10. Specifically, terminal 14 is inserted into passageway 16*b* of housing 10 in the direction of arrow "B". It can be seen that front male end 32 of the terminal is narrower than body portion 36 and is joined thereto by a tapered transition section 46. As the terminal is inserted into the passageway, the tapered transition section engages the rear sides of latch bosses 28 which, themselves, are tapered as seen in FIGS. 2 and 8. As the terminal is inserted further into the passageway, latch bosses 28 of latch walls 22*a* and 22*b* will engage side walls 36*b* of the intermediate body portion 36 of the terminal, whereupon the latch walls will flex transversely outwardly of the longitudinal axis of the terminal and passageway. In essence, as best seen in FIG. 3, latch walls 22*a* and 22*b* will flex outwardly about their living hinges defined by edges 24 integrally joined to the generally rigid wall means 18 and 20 of the housing.

When the terminal reaches its fully inserted position, with front male end 32 positioned forwardly in passageway 16*b* for mating with a complementary female terminal inserted into the passageway, flexible latch walls 22*a* and 22*b* will snap back inwardly as latch shoulders 42 on the terminal pass latch shoulders 28*a* of latch bosses 28 on the flexible latch walls. The forwardly facing latch shoulders 28*a* of the housing latch walls and the rearwardly facing latch shoulders 42 of the terminal prevent removal of the terminal from passageway 16*c*. When fully inserted, and referring to FIGS. 4 and 7, the tops of a pair of tangs 50 of terminal 14 engage upper cavity wall portion 29*a*, bottom wall 36*a* of the terminal engages lower cavity wall portion 29*b* and a forwardly facing shoulder 52 of the terminal engages stop shoulder 29*c*.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes, a dielectric housing having generally rigid wall means defining an elongated terminal-receiving passageway, a terminal adapted to be inserted longitudinally into the passageway, the terminal having a longitudinal axis and a mating portion adapted to mate with a complementary terminal inserted into the passageway, and latch means to hold the terminal in the terminal-receiving passageway in the housing, wherein the improvement in said latch means comprises:

at least one latch wall disposed within and extending longitudinally of the terminal-receiving passageway of the housing, the latch wall defining opposite longitudinal edges thereof, one longitudinal edge being joined to the generally rigid wall means of the housing, the other longitudinal edge being free and projecting into the passageway for transverse flexing about the one joined edge and a latch shoulder on the latch wall at least on a flexing portion of the wall, the latch wall adapted to be located between said rigid wall means and said terminal when said terminal is inserted into said passageway, and said terminal including a latch shoulder for snapping behind the latch shoulder of the latch wall when said terminal is inserted longitudinally into said passageway to prevent removal of the terminal from the passageway.

2. In an electrical connector as set forth in claim 1, wherein said latch shoulder on the latch wall is defined by a latch boss projecting transversely into the terminal-receiving passageway.

3. In an electrical connector as set forth in claim 1, including a pair of said latch walls extending along opposite sides of the terminal-receiving passageway.

4. In an electrical connector as set forth in claim 1, wherein said dielectric housing, including said generally rigid wall means and said latch wall, is unitarily molded of plastic material, whereby a longitudinal integral juncture between the rigid wall means and the latch wall defines a living hinge for flexing of the latch wall.

5. In an electrical connector as set forth in claim 1, wherein said terminal includes a male mating end, a terminating end and an intermediate body portion between the ends, the latch shoulder on the terminal being located on the intermediate body portion thereof.

6. In an electrical connector as set forth in claim 5, wherein said terminal comprises a stamped and formed sheet metal component.

7. An electrical connector with an improved terminal latch means, comprising:

a dielectric housing having generally rigid wall means defining an elongated terminal-receiving passageway, the housing being unitarily molded of plastic material and including at least one latch wall disposed within and extending longitudinally of the terminal-receiving passageway, the latch wall defining opposite longitudinal edges thereof, one longitudinal edge being integrally joined to the generally rigid wall means of the housing to define a living hinge for flexing of the latch wall, the other longitudinal edge of the wall being free and projecting into the passageway for transverse flexing about the one joined edge, and a latch shoulder on the latch wall at least on a flexing portion of the wall; and a terminal adapted to be longitudinally inserted into the passageway of the housing, the terminal including a mating end, a terminating end and an intermediate body portion between the ends, the body portion including a latch shoulder for snapping behind the latch shoulder of the latch wall upon proper longitudinal insertion of the terminal into the passageway to prevent removal of the terminal therefrom.

8. The electrical connector of claim 7 wherein said latch shoulder on the latch wall is defined by a latch boss projecting transversely into the terminal-receiving passageway.

9. The electrical connector of claim 7 including a pair of said latch walls extending along opposite sides of the terminal-receiving passageway.

10. The electrical connector of claim 7 wherein said terminal comprises a stamped and formed sheet metal component.

* * * * *